US008061041B2

(12) United States Patent
Jessemey et al.

(10) Patent No.: US 8,061,041 B2
(45) Date of Patent: Nov. 22, 2011

(54) SAFETY RAZOR

(75) Inventors: Paul Michael Jessemey, Lambourn (GB); Roy Nicoll, Wokingham (GB); Robert Anthony Hart, Bracknell (GB); Vincent P. Walker, Bridgewater, MA (US)

(73) Assignee: The Gillette Company, Boston, MA (US)

( * ) Notice: Subject to any disclaimer, the term of this patent is extended or adjusted under 35 U.S.C. 154(b) by 465 days.

(21) Appl. No.: 11/799,843

(22) Filed: May 3, 2007

(65) Prior Publication Data

US 2008/0189953 A1 Aug. 14, 2008

Related U.S. Application Data

(60) Provisional application No. 60/901,535, filed on Feb. 14, 2007.

(51) Int. Cl.
*B26B 19/28* (2006.01)

(52) U.S. Cl. ..... 30/45; 30/50

(58) Field of Classification Search ..... 30/32, 39, 30/42–45, 50, 526, 527, 535, 41–41.8
See application file for complete search history.

(56) References Cited

U.S. PATENT DOCUMENTS

| | | | | |
|---|---|---|---|---|
| 2,511,188 | A | 6/1950 | Whipple | |
| 3,611,568 | A | 10/1971 | Alexander et al. | |
| 4,094,062 | A | 6/1978 | Papanikolaou | |
| 4,380,121 | A | 4/1983 | Naimer et al. | |
| 4,473,943 | A | 10/1984 | Papanikolaou | |
| 4,493,975 | A | 1/1985 | Yamamoto | |
| 4,531,287 | A | 7/1985 | Shibata et al. | |
| 4,744,124 | A | 5/1988 | Wang et al. | |
| 4,939,407 | A | 7/1990 | Goo et al. | |
| 5,046,249 | A | 9/1991 | Kawara et al. | |
| 5,214,851 | A | 6/1993 | Althaus | |
| 5,299,104 | A | 3/1994 | Parmentier | |
| 5,299,354 | A | 4/1994 | Metcalf et al. | |
| 5,337,478 | A | 8/1994 | Cohen et al. | |
| 5,582,476 | A | 12/1996 | Hansen | |
| 5,711,328 | A | 1/1998 | Braun | |
| 5,732,470 | A * | 3/1998 | Labarbara | 30/45 |
| 5,782,346 | A | 7/1998 | Gray et al. | |
| 6,009,623 | A | 1/2000 | Orloff | |
| 6,070,327 | A * | 6/2000 | Taso | 30/537 |
| 6,227,676 | B1 | 5/2001 | Sneddon | |

(Continued)

FOREIGN PATENT DOCUMENTS

| | | |
|---|---|---|
| DE | 7728867 | 2/1978 |

(Continued)

OTHER PUBLICATIONS

PCT Search Report mail date Jun. 27, 2008, 15 pages.

*Primary Examiner* — Jason Daniel Prone
(74) *Attorney, Agent, or Firm* — Jay A. Krebs

(57) ABSTRACT

A safety razor has a blade unit having at least one blade with a sharp cutting edge. A dielectric handle is configured to carry the blade unit and a conductive ground member is disposed within the handle. The safety razor has an electrically operated device. An electrical arrangement having a sensor electrically coupled to the blade unit and the ground member senses skin contact with the blade unit and actuates the device based on the sensing.

15 Claims, 13 Drawing Sheets

U.S. PATENT DOCUMENTS

| | | | | |
|---|---|---|---|---|
| 6,406,157 | B1 | 6/2002 | Audet | |
| 6,421,918 | B1 | 7/2002 | Dato et al. | |
| 6,460,251 | B1 | 10/2002 | Orloff | |
| 6,481,104 | B1 | 11/2002 | Parker et al. | |
| 6,497,043 | B1 | 12/2002 | Jacobsen | |
| 7,170,034 | B2 * | 1/2007 | Shalev et al. | 30/34.05 |
| 7,367,126 | B2 * | 5/2008 | Freund et al. | 30/34.05 |
| 7,415,767 | B2 * | 8/2008 | Saker et al. | 30/34.05 |
| 7,441,336 | B2 * | 10/2008 | Hawes et al. | 30/45 |
| 7,596,866 | B2 * | 10/2009 | Saker et al. | 30/45 |
| 7,637,014 | B2 * | 12/2009 | Schnak et al. | 30/44 |
| 7,654,003 | B2 * | 2/2010 | Simms et al. | 30/34.05 |
| 7,669,335 | B2 * | 3/2010 | Walker et al. | 30/34.1 |
| 7,703,209 | B2 * | 4/2010 | Freund et al. | 30/41.7 |
| 7,810,243 | B2 * | 10/2010 | Schnak et al. | 30/44 |
| 2002/0088068 | A1 | 7/2002 | Levy et al. | |
| 2002/0189102 | A1 | 12/2002 | Orloff | |
| 2003/0000032 | A1 | 1/2003 | Lev | |
| 2003/0154832 | A1 | 8/2003 | Guimont et al. | |
| 2004/0098862 | A1 * | 5/2004 | Orloff | 30/41.8 |
| 2004/0261270 | A1 * | 12/2004 | Daryanani | 30/34.05 |
| 2006/0032053 | A1 * | 2/2006 | Saker et al. | 30/34.05 |
| 2006/0032054 | A1 * | 2/2006 | Simms et al. | 30/34.05 |
| 2006/0032055 | A1 * | 2/2006 | Simms et al. | 30/537 |
| 2006/0037197 | A1 | 2/2006 | Hawes et al. | |
| 2007/0050983 | A1 * | 3/2007 | Schnak et al. | 30/45 |
| 2008/0016692 | A1 * | 1/2008 | Noble | 30/41.5 |
| 2008/0134511 | A1 * | 6/2008 | Salvatore | 30/32 |
| 2008/0271319 | A1 * | 11/2008 | Saker et al. | 30/45 |
| 2008/0289185 | A1 * | 11/2008 | Clarke | 30/41.5 |
| 2009/0007433 | A1 * | 1/2009 | Hawes et al. | 30/45 |
| 2009/0019701 | A1 * | 1/2009 | Simms et al. | 30/32 |
| 2009/0071008 | A1 * | 3/2009 | Hart et al. | 30/34.05 |
| 2009/0071010 | A1 * | 3/2009 | Hart | 30/45 |
| 2009/0119923 | A1 * | 5/2009 | Hart et al. | 30/45 |
| 2009/0255123 | A1 * | 10/2009 | Tomassetti et al. | 30/34.05 |

FOREIGN PATENT DOCUMENTS

| | | |
|---|---|---|
| DE | 3122521 | 12/1982 |
| DE | 4228859 | 3/1994 |
| DE | 19627734 | 1/1998 |
| DE | 20113379 | 12/2001 |
| DE | 20201967 | 6/2002 |
| DE | 10117766 | 10/2002 |
| EP | 0 524 708 | 1/1993 |
| GB | 2 054 151 | 2/1981 |
| GB | 2 074 322 | 10/1981 |
| GB | 2 250 428 | 6/1992 |
| GB | 2 258 922 | 2/1993 |
| GB | 2 361 889 | 11/2001 |
| GB | 2 377 995 | 1/2003 |
| JP | 05-329024 | 12/1993 |
| JP | 09-051740 | 2/1997 |
| RU | 2 180 880 | 3/2002 |
| WO | WO 94/05229 | 3/1994 |
| WO | WO 96/05028 | 2/1996 |
| WO | WO 02/45920 | 6/2002 |
| WO | WO 2004/073941 | 9/2004 |

* cited by examiner

FIG. 8
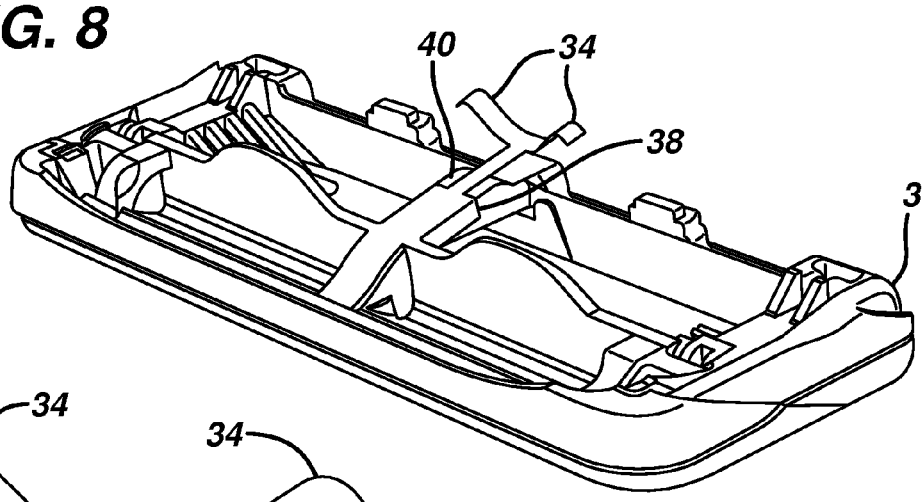
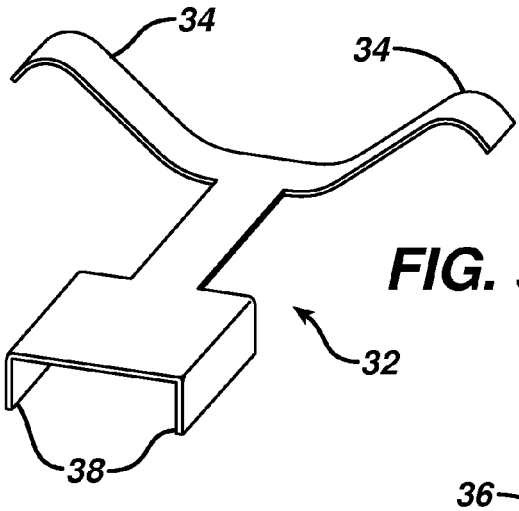
FIG. 9
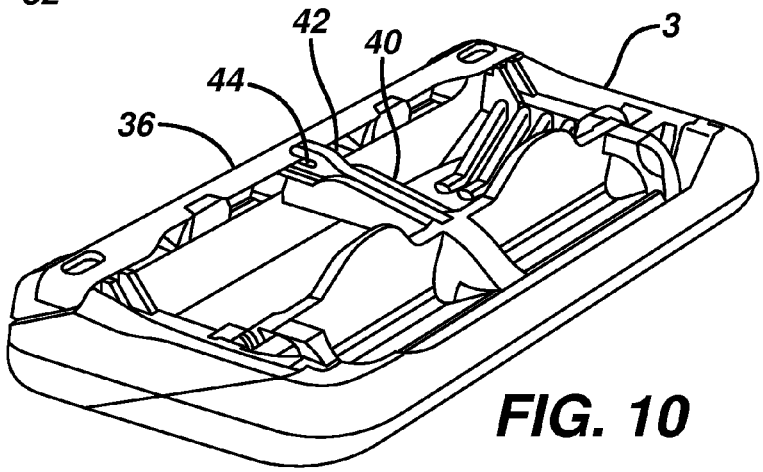
FIG. 10
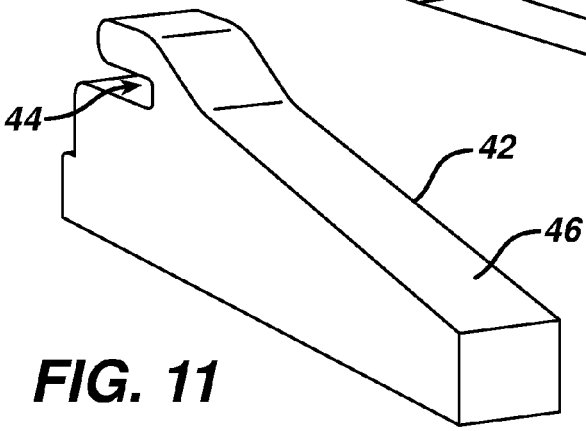
FIG. 11

SAFETY RAZOR

CROSS REFERENCE TO RELATED APPLICATIONS

This application claims the benefit of U.S. Provisional Application No. 60/901,535 filed Feb. 14, 2007.

FIELD OF THE INVENTION

This invention relates to safety razors, and more particularly to wet razors having an electrically operated device, such as a vibration mechanism.

BACKGROUND OF THE INVENTION

A safety razor generally has a handle and a blade unit carried on the handle and at least one blade with a sharp cutting edge. In the course of shaving the blade unit is applied against the skin and the blade or blades are moved across the skin so that the sharp cutting edges engage and cut through the hairs protruding from the skin. The blade unit can be fixed on the handle with the intention that the entire razor should be discarded when the cutting edges have become dull and no longer capable of providing a comfortable shave. Alternatively the blade unit may be removably mounted on the handle so that the blade unit can be replaced by a new blade unit when the sharpness of the blades has diminished to an unacceptable level. Replaceable blade units are often referred to as shaving cartridges.

Some razors may include an electrically driven vibration mechanism for vibrating the razor, since vibrating may have a beneficial effect on razor performance. A simple and convenient vibration generating mechanism has of an electric motor with a weight mounted eccentrically on its output shaft. The vibration mechanism may incorporate a piezoelectric device for producing the vibrations. The vibration mechanism and a battery for providing electric power to the motor can be conveniently housed in the razor handle. Some safety razors include a light emitting diode which is illuminated when the safety razor is turned on. Some vibrating razors include a power meter or indication to indicate the battery power remaining and/or to indicate when a new battery is needed.

A vibration mechanism may be adapted to vibrate only one or more selected components of the blade unit, such as the guard which contacts the skin in front of the blades, or one or more blades, and the vibration may be directional, for instance directed lengthwise of the blades to encourage a slicing cutting action or transverse to the blades. Another possibility is for an element to be vibrated in a direction generally perpendicular to the skin surface being shaved.

Other forms of electrical devices besides vibration generators may be included in wet razors, some examples of such devices being:

(i) heating devices for heating one or more blades or other components of a blade unit which contact the skin during shaving, such as Peltier devices or electrical resistance or ohmic heating devices;

(ii) dispensing devices for delivering a shaving enhancement product to the skin and which may be activated by operation of a motor driven pump or by operation of a valve having an electrically controlled actuator, shaving enhancement products which can be delivered at a safety razor blade unit during performance of a shaving stroke including those with the qualities and properties mentioned in patent application No. WO00/47374 the contents of which are incorporated herein by reference;

(iii) conditioning devices to prepare the skin and/or hairs ready to be cut by the blades, such as a roller mounted in the region of the guard of the blade unit and adapted to be rotated about its axis for encouraging hairs lying against the skin to stand up for cutting;

(iv) illumination devices for illuminating an area of skin being shaved; and (v) actuators for adjusting the blade unit in accordance with prevailing shaving conditions detected by a sensor.

When there is an electrical device included in a safety razor it is often convenient for the device to be operated by a replaceable or rechargeable electric storage battery which can be housed within the razor handle. To conserve battery power, the electrical device may be disconnected from the battery during periods when the razor is not in use. In some cases it may be immediately obvious to a user when connection between the electrical device and battery established, such as if the device is a vibration generator which is set into operation as soon as the electrical connection to the battery is made, but there may be other cases where it is not so obvious.

Some razors have a blade unit including an electrically conductive (e.g., metal) casing that serves as an electrode for electrical contact with the hand of a user. The handle may also serve as an electrode for electrical contact with the user's skin. A control device starts a vibration source when a person holding the razor by the handle touches the blade unit against the skin surface, such as when shaving. After the blade unit is lifted away from the skin surface, the control device stops the vibration source.

A capacitive sensor detects the proximity of a conductive object. Capacitive sensing is used in interface applications to build non-contact switches (or sensors). Very simply, a capacitive sensor is a pair of adjacent plates. When a conductive object is placed in proximity to these plates, there is capacitance between the electrodes and the conductive object. The capacitance measured by the sensor is a function of the distance from the sensor to the object. The most common form of capacitance sensor array is a set of capacitors where one side of each is grounded. The presence of a conductive object increases the capacitance of the switch to ground, and determining sensor activation is only a matter of measuring change in capacitance.

A capacitive sensor often requires a number of other support functions for practical use, such as programmable current source, an analog multiplexer, and an auto-calibration system, for example. Sensor support may be implemented with a mixed-signal programmable system-on-chip device.

SUMMARY OF THE INVENTION

This invention relates to safety razors. More particularly, this invention relates to wet razors having an electrically operated device, such as a vibration mechanism, and actuation of the device.

In one aspect, the invention features, in general, a safety razor having a blade unit with at least one blade having a sharp cutting edge. A dielectric handle carries the blade unit and a conductive ground member is disposed within the handle. An electrically operated device is included. An electrical arrangement has a sensor electrically coupled to the blade unit and the ground member. The sensor senses skin contact with the blade unit and actuates the device based on the sensing.

In another aspect, the invention features, in general, a method of operating a safety razor. A razor having a blade unit with at least one blade having a sharp cutting edge and a dielectric handle configured to carry the blade unit is selected. The blade unit is electrically coupled to a capacitance. A first time period is measured for charging the capacitance to a known voltage and discharging the capacitance. A second time period for the charging and discharging. An electrically operated device is actuated based on the measured time periods.

Certain implementations of the invention may include one or more of the following features. The electrical arrangement has a sensing path between the blade unit and the ground member, the sensing path having an inherent capacitance. The sensor measures a cycle time for charging the capacitance to an upper voltage and discharging the capacitance to a lower voltage and actuates the device when the cycle time exceeds a threshold value. The ground member and the handle capacitively couple with a user when the user holds the handle and disposes the blade unit on the user's skin. The ground member is enclosed within the handle. The electrical arrangement includes a programmable system-on-chip. The safety razor has a plunger for biasing the blade unit to a shaving position and a follower disposed on the housing. The sensor is electrically coupled to the blade unit through the plunger and the follower. The follower has a body disposed in a first plane, a neck projecting distally from the body, and first and second contacts opposedly extending from the neck. Each contact has a contact surface disposed in a second plane. The contact members resiliently bend when assembled in the blade unit. The sensor is electrically coupled to a blade. A switch controls operation of the electrical arrangement between a normal mode and a low power consumption mode. The switch is included in the handle. The electrically operated device is a motor. An indicator produces a signal indicating to a razor user that the electrical arrangement is connected to the power source and ready to actuate the electrical device. The indicator has a light emitting device. The device is a diode. The indicator produces an oscillation or vibration of the razor. The indicator generates an audible signal. Actuating based on measured time periods includes calculating the difference between first and second time periods and actuating the device when the difference exceeds a threshold value and deactivating the device when the difference is less than a threshold value. Actuating includes deactivating the device a period of time after the difference is less than the threshold value.

Other features and advantages of the invention will be apparent from the description of the preferred embodiments thereof and from the claims.

BRIEF DESCRIPTION OF THE DRAWINGS

FIG. 8 is an isometric view showing a partial assembly of the cartridge;

FIG. 9 is an isometric view showing an example of a conductive strip;

FIG. 10 is an isometric view showing an example of a partially assembled cartridge;

FIG. 11 is an isometric view of an example of a conductive member;

DETAILED DESCRIPTION OF THE INVENTION

Figure 1:
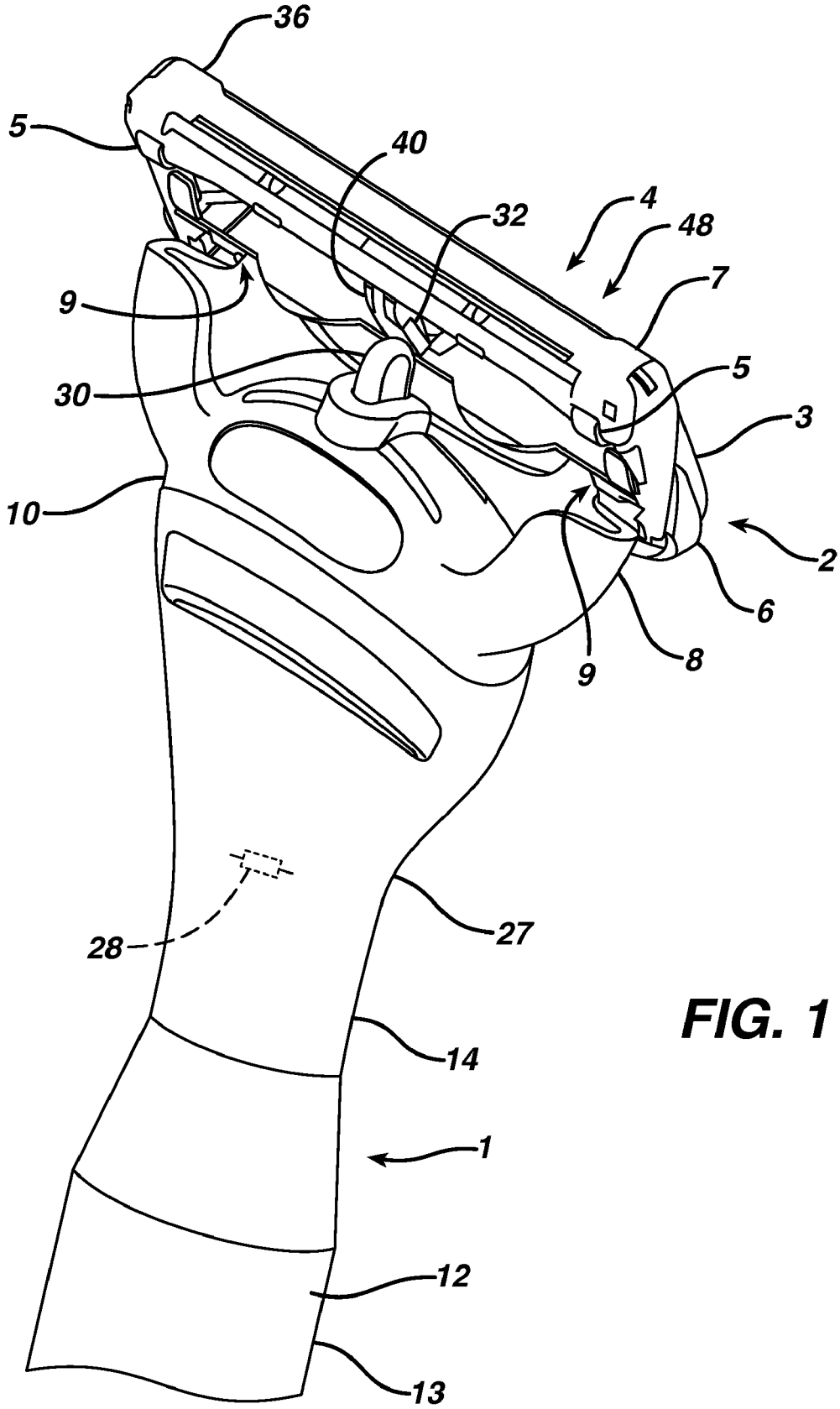
FIG. 1 is a partial isometric view showing an example of a razor as seen from the rear.
Figure 2:
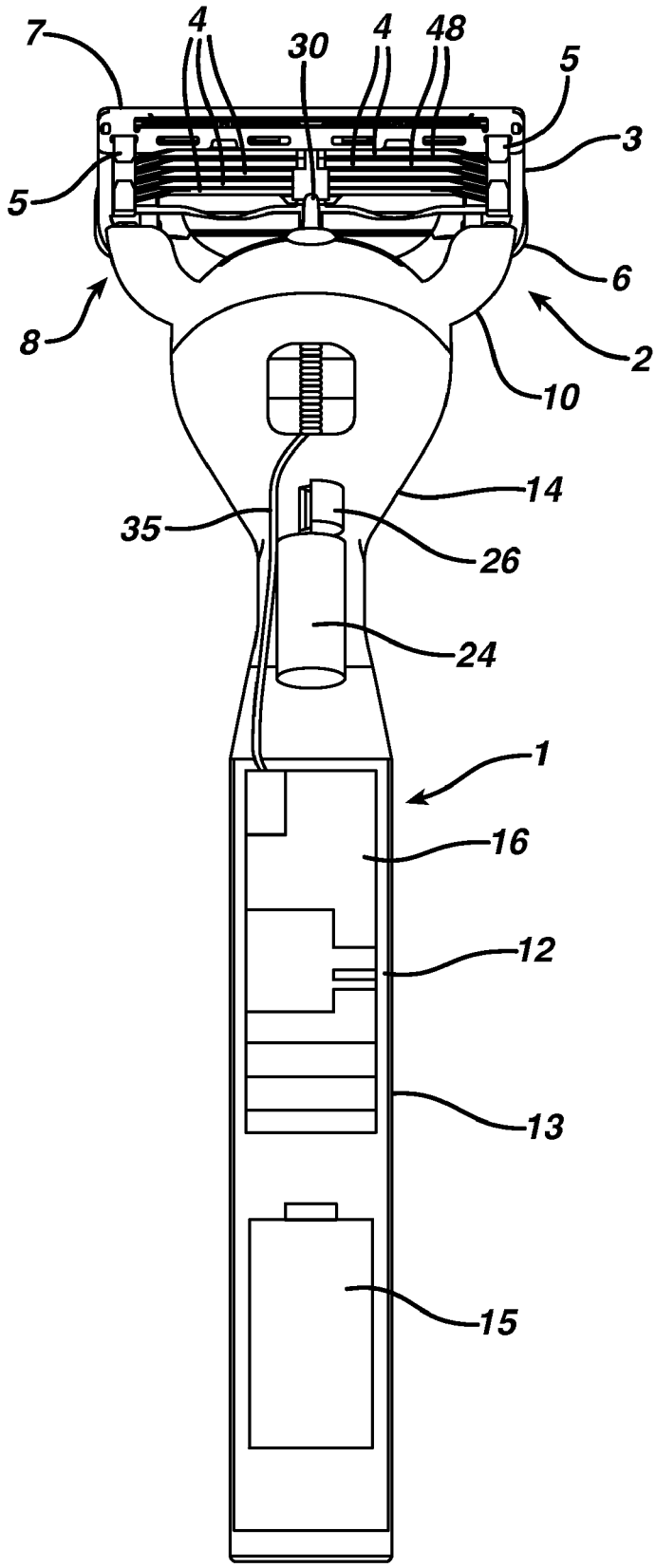
FIG. 2 is a rear view showing the razor with a partial section view showing a contact.

Referring to FIGS. 1 and 2, the safety razor illustrated in the drawings has a handle 1 and a blade unit or cartridge 2 detachably mounted on the upper end of the handle. The blade unit 2 includes a generally rectangular frame 3, and a plurality, e.g., three, four or five, blades 4 with substantially parallel sharp cutting edges, disposed in the frame and held in place by metal clips 5 positioned around the frame 3 at the opposite ends of the blade unit 2. A guard structure 6 including a strip of elastomeric material is provided on the frame for contacting the skin in front of the blades, and a cap structure 7 including a lubricating strip is provided on the frame for contacting the skin behind the blades during the performance of a shaving stroke. The frame is pivotally carried on a yoke member 8 having a pair of arms 9 which extend from a hub 10 and are journaled in opposite ends of the frame 2 so that the blade unit 2 can pivot relative to the handle 1 about an axis substantially parallel to the blade edges. The hub 10 is connected detachably to the end of the handle 1. As so-far described the razor is of a known construction and for further details reference may be made to earlier patent publications, one example of which is U.S. Pat. No. 7,669,335, incorporated herein by reference.

The razor handle 1 includes a main portion 12 intended to be gripped in the hand and a neck 14 extending upwardly from the main portion and to the free end of which the blade unit 2 is attached. The main or gripping portion 12 of the handle 1 includes an electrically non-conductive casing 13, for example. Housed within a battery compartment in the handle is a replaceable or rechargeable battery 15, which constitutes a power supply for an electronic control device 16, also accommodated within the handle.

In some examples, the battery 15 is electrically connected to the control device 16 through a power switch that is operable to interrupt power supply to the control device for conserving battery energy during periods when the razor is not being used. The power switch could be located on the handle for manual operation, but in a useful construction the power switch is arranged to be actuated by removing the razor from, and returning it to, a razor holder on which the razor is intended to be stored when not in use. A known form of razor holder consists of a tray 18 as shown in FIGS. 3-5, the tray 18 having on its upper side a saddle 19 adapted to receive and lightly grip the neck 14 of the razor handle 1.

Figure 3:
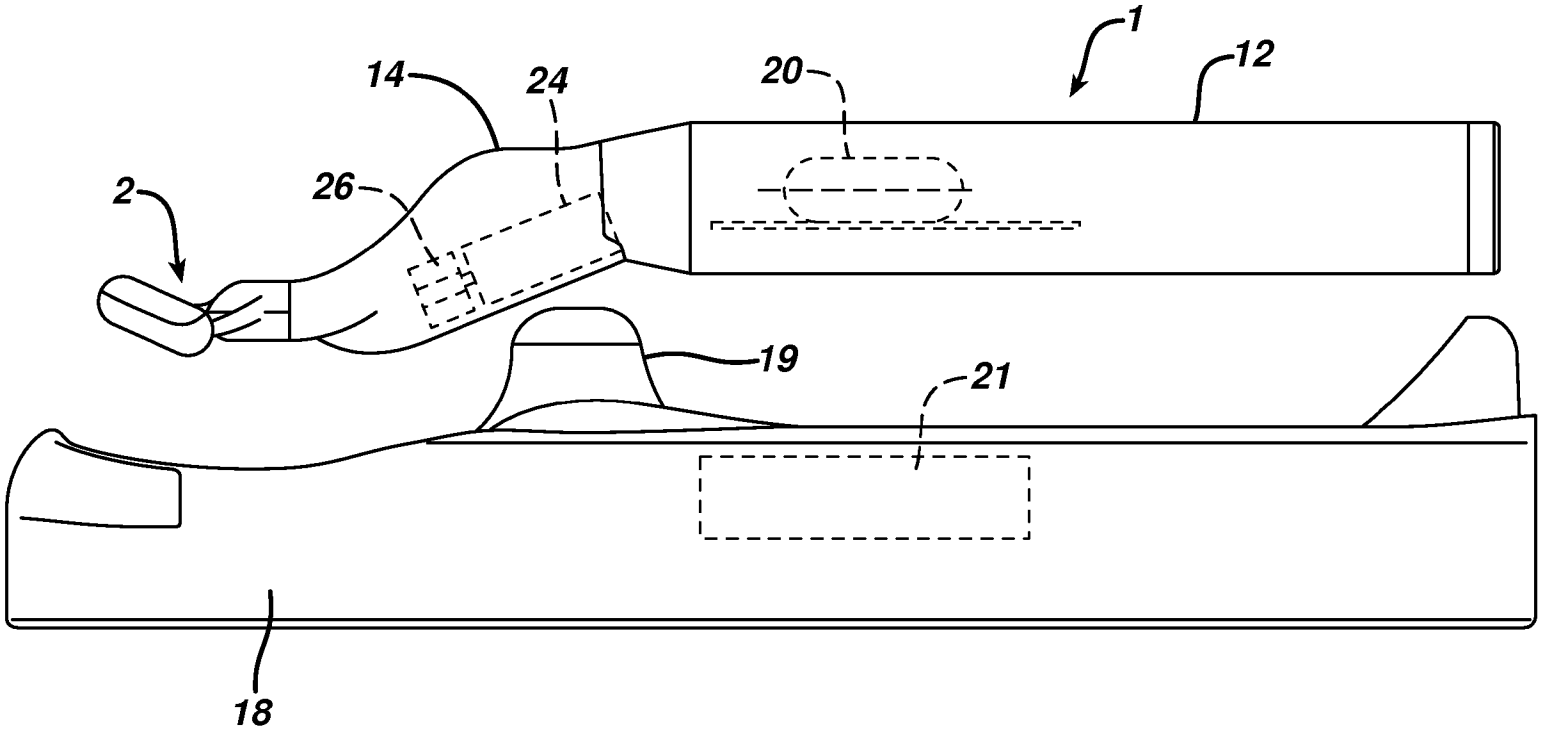
FIG. 3 is a side elevation showing an example of a razor separated by a small distance from a razor holder in the form of a tray on which the razor is stored during periods of non-use.
Figure 4:
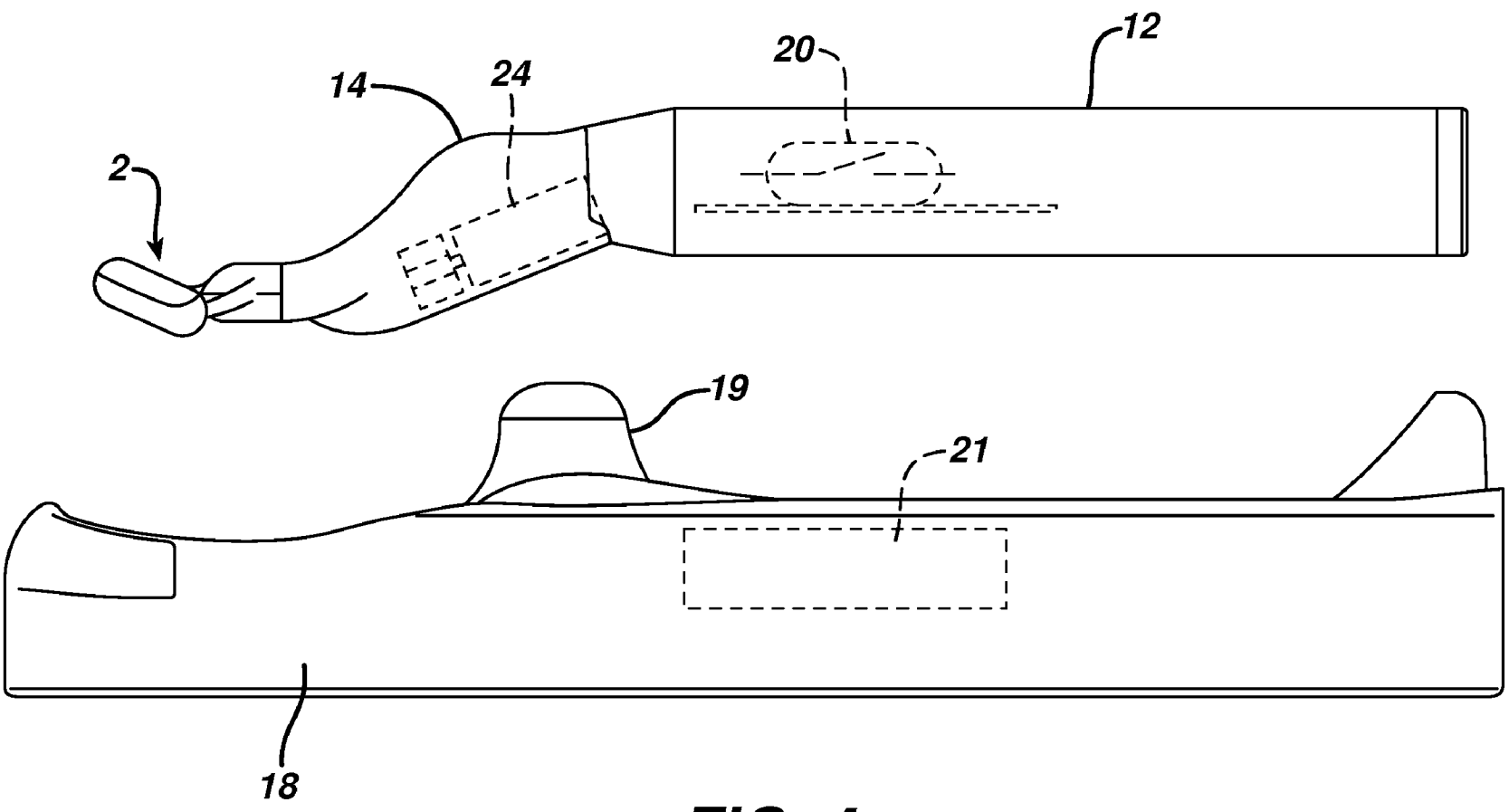
FIG. 4 is a side elevation showing the razor at a greater distance from the storage tray.
Figure 5:
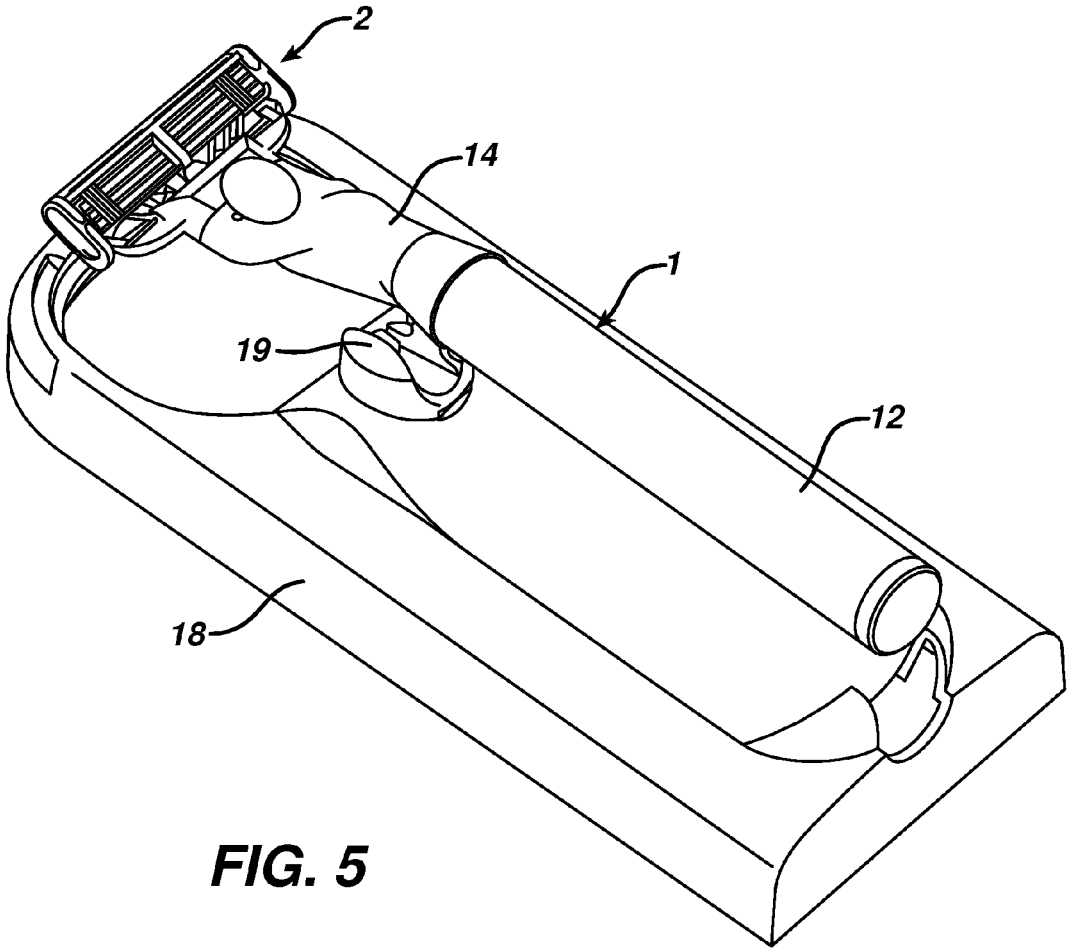
FIG. 5 is an isometric view showing the razor and the storage tray.
Figure 6:
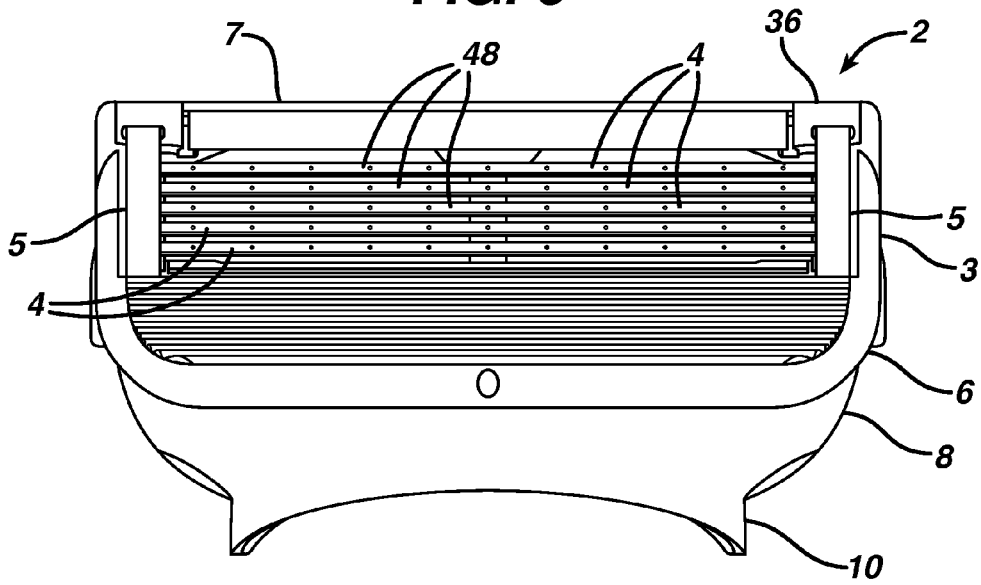
FIG. 6 is a front view showing an example of a cartridge.
Figure 7:
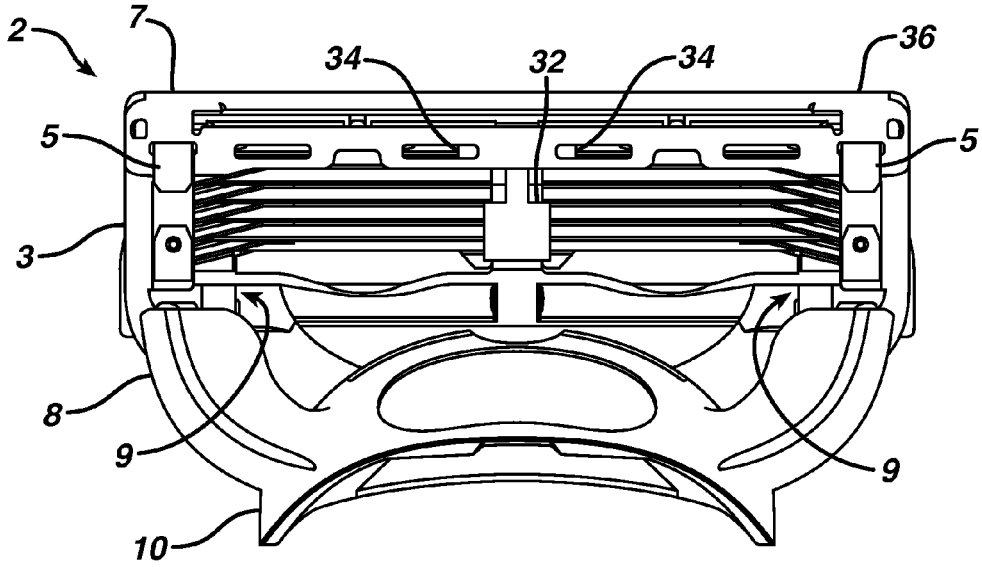
FIG. 7 is a rear view showing the cartridge.

Referring to FIGS. 3-5, in some examples, a power switch in the form of a reed switch 20 is located within the handle 1. Storage tray 18 has a permanent magnet 21 located in a position close to saddle 19. The reed switch is disposed in the handle 1 at or adjacent to the portion of the neck 14 adapted to be gripped in saddle 19. When the razor is positioned close to the tray 18, the reed switch 20 is held closed and the control device 16 responds by entering a low power sleep mode. But when the razor is moved away from the tray the reed switch 20 opens the control device 16 resumes normal operation. In other examples, the razor handle 1 could be equipped with a mechanical switch for cooperation with the storage tray 18. The mechanical switch could be operated automatically when the razor is lifted away from the storage tray 18 the control device 16 to resume normal operation, and to be actuated upon replacement of the razor on the tray to enter a low power sleep mode. In other examples, this operation could be controlled by a momentary switch.

Referring to FIG. 1, in some examples, the neck 14 of the handle includes a transparent section 27 which extends around the entire periphery of the neck and along a major part of the length of the neck. Positioned within the handle for illuminating this transparent neck section 27, preferably with light of a distinctive color, e.g., blue light, is a light emitting diode 28. Light emitting diode 28 is energized when control device 16 is in its normal operating mode. Powering light emitting diode 28 results in the internal illumination of the neck section 27 which then takes on a softly glowing external visual appearance, thereby providing the razor user with an unmistakable, highly visible, indication that control device 16 is in normal operating mode and the razor is ready to be used. As discussed above, in one example, the razor is ready to use when moved away from its storage tray.

Referring to FIG. 2, the control device 16 controls actuation of an electric motor 24 housed within the handle 1 and having an output shaft with an eccentric weight 26 fastened thereon. Energizing the electric motor results in a high speed rotation of the eccentric weight 26 and thereby vibration of the razor and the blade unit 2. In one example, a suitable vibration frequency is around 120 Hz.

Generally, control device 16 is configured to be touch-sensitive so that the electric motor 24 is actuated when the blade unit 2 of the razor is brought into contact with a user's skin surface, e.g., at the start of a shaving stroke. Upon skin contact, motor 24 is actuated to drive the vibration generating eccentric weight 26. Vibrating the blade unit as is moves across the skin can have a beneficial effect on the shaving performance. When the blade unit is lifted away from the skin surface the vibration stops. It has been found that the discomfort perceived by users of vibrating razors applies for the most part only when the razor is held within blade unit away from the body in free space and by having vibration occur only when the razor is actually shaving and during rinsing of the blade unit, user prejudices against vibrating razors are mostly eliminated. The control device could be arranged to provide a short delay between interruption of contact between the blade unit and the skin of the user and turning off the power supply to the motor. In some examples the delay could be up to about 3 seconds, preferably between about 0.1 to 0.5 seconds, and more preferably about 0.3 seconds. Maintaining the vibration of the razor between shaving strokes performed in quick succession may be beneficial.

Referring to FIGS. 1-2 and 6-9, blade unit 2 incorporates an electrode constituted by at least one and preferably all of blades 4. Electrical connection between the control device 16 and the electrode (e.g., blades 4) is achieved, for example, by a contact 30 arranged to project through the hub 10 of the yoke member 8 and to bear against a contact strip 32 fixed to the rear of the blade unit. The contact strip 32 has lateral wings 34 extending to and conductively connecting with metal bracket 36. Lateral wings 34 are disposed rearwardly so that bracket 36 pushes them forward when assembled for better electrical contact. Metal blade retention clips 5 electrically couple blades 4 to bracket 36. Contact strip 32 has forwardly projecting walls 38 that are crimped onto center pillar 40 to secure contact strip 32 to frame 3. In other examples, the electrode could be a separate conductive element disposed on blade unit 2 for contacting the skin when blade unit 2 performs a shaving stroke.

The contact 30 makes constant electrical contact with the contact strip 32 so that the electrical continuity between the electrode and the blade unit is not interrupted even during pivoting of the blade unit 2 on the handle 1 as tends to occur as the blade unit applied to and moved across the skin. The contact 30 conveniently takes the form of a spring-loaded plunger for resisting pivotal movement of the blade unit away from a predetermined rest position. The contact 30 is shown connected electrically to the control device 16 by a wire conductor 35 which is led through neck 14 of the handle 1.

Referring to FIGS. 10 and 11, in an alternative example, center pillar 40 is integrally formed around a conductive member 42. Bracket 36 is attached to and electrically connected to member 42 by insertion into slot 44. Conductive member 42 is arranged within pillar 40 so that contact 30 bears against top surface 46 and electrically connect blades 4 and control device 16.

Of course there are other possibilities to ensure electrical connection of the electrode on blade unit 2 and control device 16. For example, frame 3 could be made of an electrically conductive material, such as conductive plastics. Also the rear of the frame 3 could be plated, coated, or printed with conductive material, or have an adhesive metal foil applied to it. Alternatively, frame 3 may include an injection molded metal part to provide the conductive path between the electrode and the contact 30. Water held in capillary grooves formed in frame 3 may be sufficient to ensure the electrical continuity.

Figure 12:
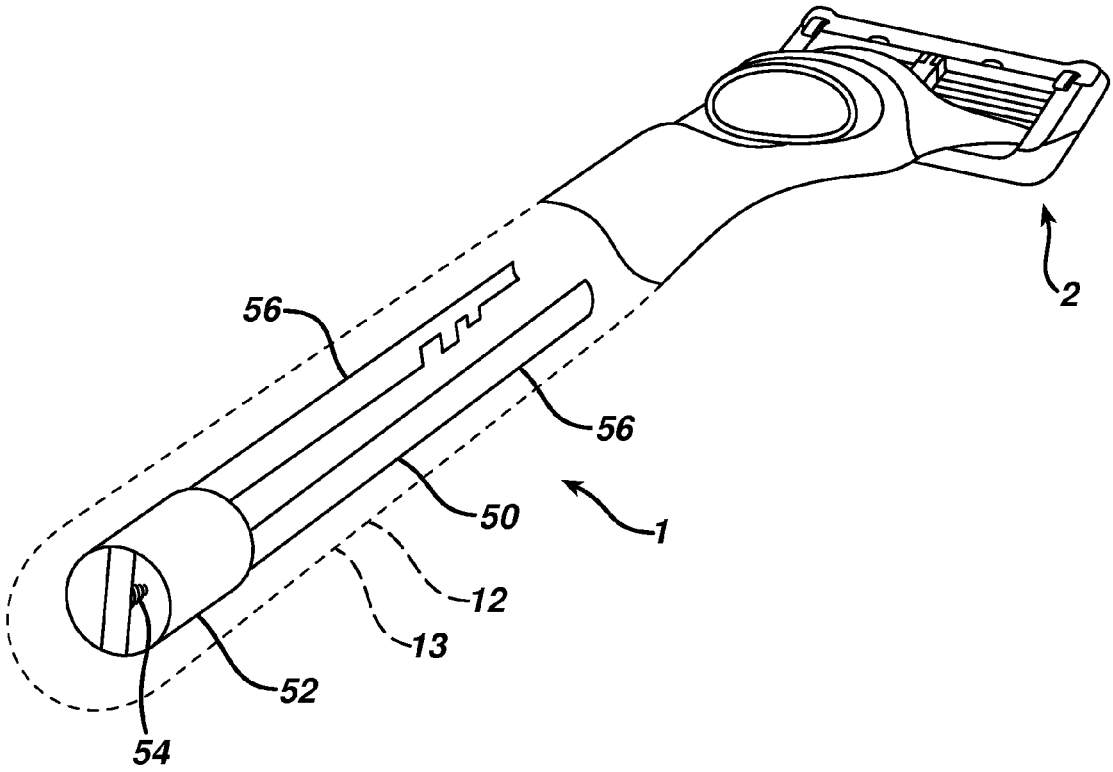
FIG. 12 is an isometric view showing an example of a ground electrode included in the razor.

Referring to FIG. 12, in some examples, razor 1 includes a conductive frame carrier 50 for grounding battery 15 and control device 16. Frame carrier 50 has a hollow cylindrical body 52 for receiving battery 15 and a contact 54 for electrically coupling battery 15 to carrier 50. Arms 56 extend distally through the main portion 12 of handle 1 from body 52 and are electrically coupled to control device 16. Electrically non-conductive casing 13 surrounds frame carrier 50 and prevents bodily contact with it when the razor is used.

Figure 13:
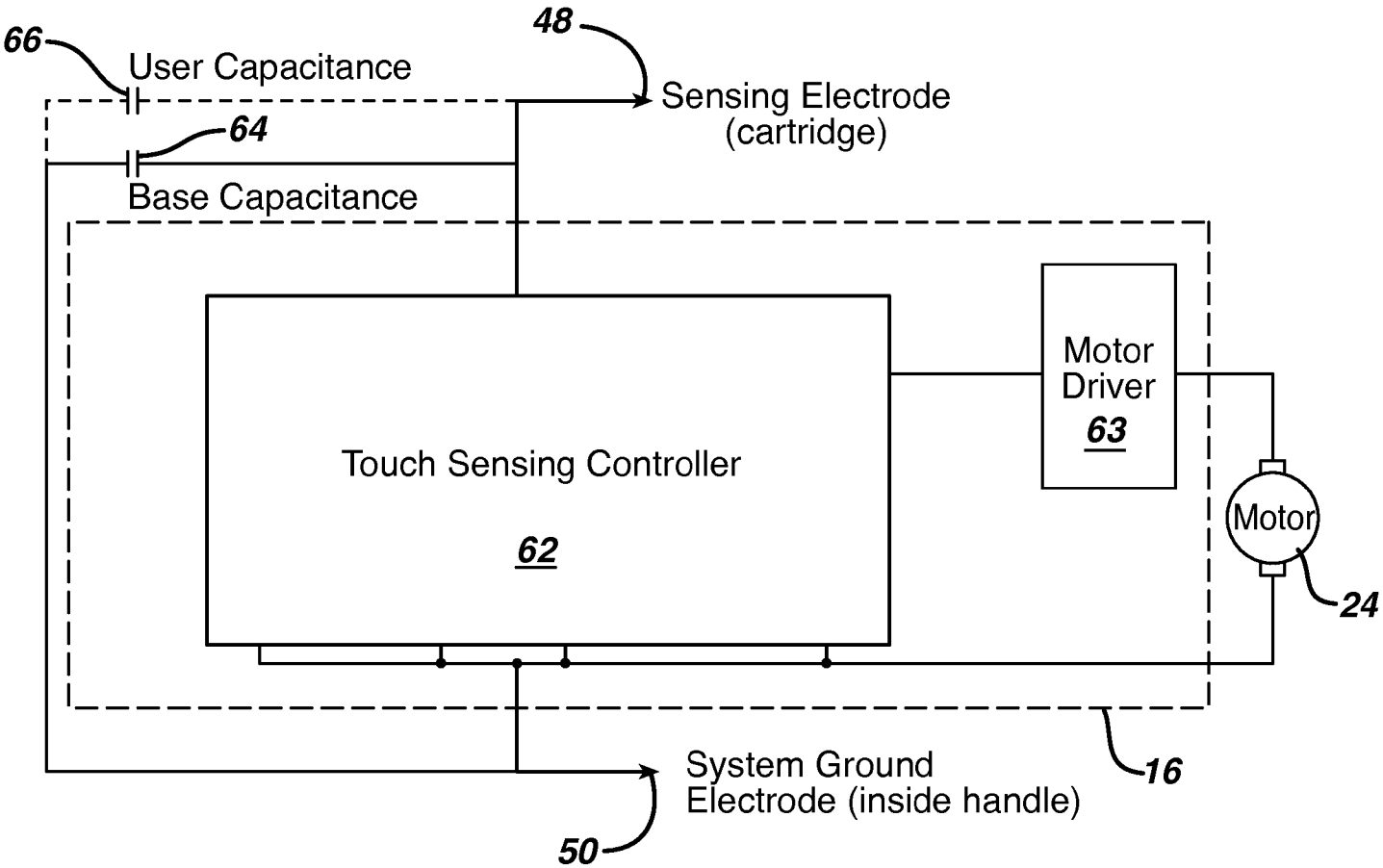
FIG. 13 is a block diagram of an example of an electronic control device included in the razor.

Referring to FIG. 13, touch sensing generally may be accomplished by measuring capacitance changes. In one example, an inherent capacitance (called the base capacitance) exists between electrode 48 and frame carrier 50, which acts as system ground electrode. These electrodes are connected to control device 16 and form a touch sensing path. For clarity, the base capacitance is represented in FIG. 13 by capacitor 64 and will be referred to as such hereinafter. But it should be understood that this example does not incorporate the distinct capacitor shown.

A user holding the razor may alter the capacitance of the touch sensing path. The user establishes a capacitive coupling with the control device 16 through the handle 12. Frame carrier 50 acts as one plate of a capacitor and the user's body, when connected to electrode 48 (for example during a shaving stroke), acts as the opposing plate. The electrically non-conductive casing 13, held in the user's hand, acts as a dielectric between the two plates. The user does not touch frame carrier 50. This causes a measurable alteration to the capacitance of the touch sensing path, as it adds to the base capacitance between electrode 48 and the system ground electrode. For clarity, the user capacitance is represented in FIG. 13 by capacitor 66 and will be referred to as such hereinafter. But it should be understood that this example does not incorporate the distinct capacitor shown.

In some examples, skin contact is sensed in the following manner. The base capacitance 64 is charged and discharged between defined upper and lower voltage limits, and the time taken to do this is measured (i.e, a charge cycle time). Skin contact introduces the user capacitance 66 parallel to the base capacitance 64. This adds to the overall capacitance of the touch sensing path and increases charge cycle time. Controller 62 senses the contact with skin or water by detecting the charge cycle time increase. When the charge cycle time exceeds a threshold value, controller 62 recognizes that skin contact exists. When the charge cycle time falls below the threshold value, controller 62 recognizes that skin contact is absent. In some examples, skin proximity or water contact could be detected in a similar manner. Touch sensing controller 62 and motor driver 63 control the drive current to motor 24. As described above, battery 15 provides power to control device 16. The power connections are omitted from FIG. 12 for clarity.

Figure 14:
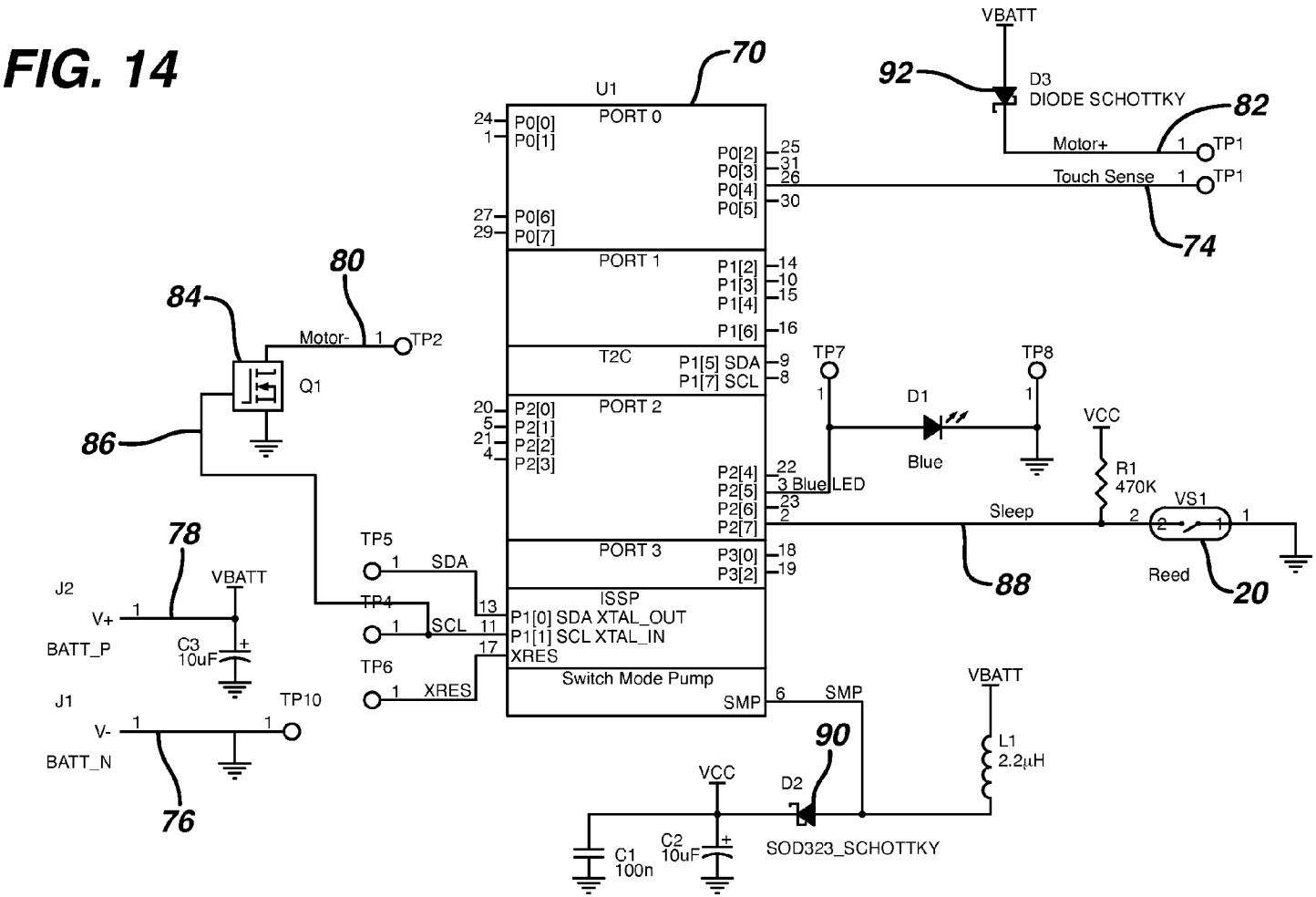
FIG. 14 is an electrical schematic showing an example of the control device.
Figure 15A:
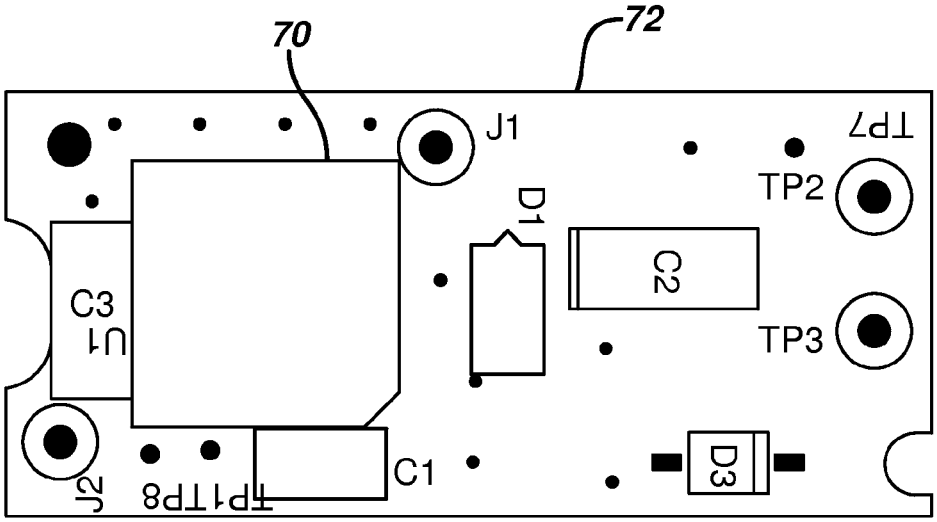
FIGS. 15A and 15B are top and bottom views of an example of a printed circuit board.
Figure 15B:
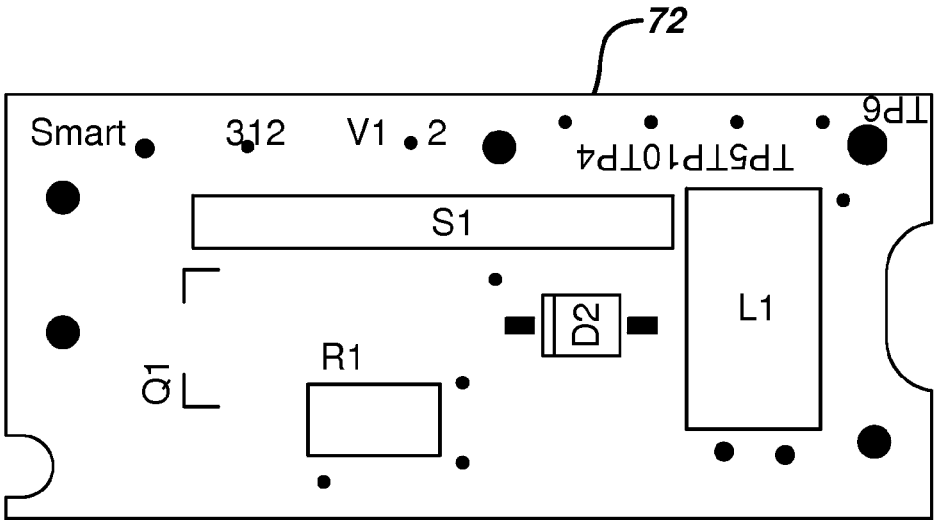

Referring to FIGS. 14 and 15A-B, in some examples, touch sensing controller 62 includes a programmable systems-on-chip (hereinafter "PSoC") for implementing the touch sensing functions (i.e., sensing skin contact with electrode 48) and for controlling motor 24. The PSoC integrates a microcontroller and the analog and digital components that typically surround it in an embedded system. In one example, controller 62 includes PSoC Mixed-Signal Array CY8C21634, available from Cypress Semiconductors Corp. of San Jose, Calif.

PSoC 70 is coupled to electrode 48 by line 74 through connection TP1 on board 72. Battery 15 provides power through lines 76, 78 and connections J1 and J2, respectively. Motor 24 is connected to PSoC 70 through lines 80, 82 and connections TP2 and TP3, respectively. PSoC 70 controls motor 24 by sending a signal to switch 84 (which in this case is a MOSFET, but could be any other type of transistor or switching device), located at Q1 on board 72, through line 86. Reed switch 20 is connected through line 88 and is disposed at S1. Diode 90, located at D2 forms part of the switch mode pump circuit required to boost the battery voltage to the correct level for touch sensing controller 62 to operate. Diode 92, located at D3, provides a voltage drop from battery 15 to motor 24, and isolates the touch sensing controller 62 from back electromotive force from motor 24.

Figure 16A:
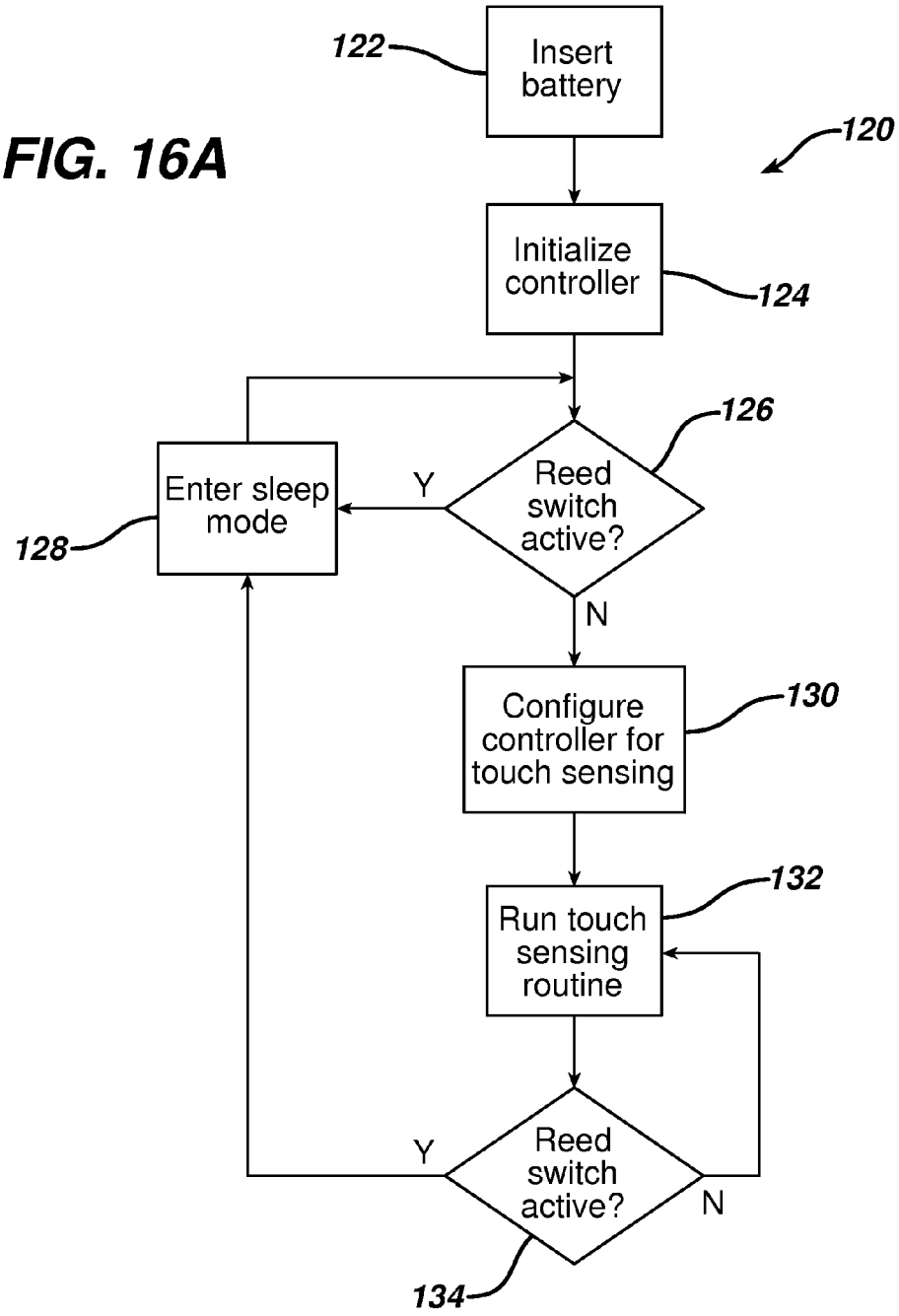
FIGS. 16A and 16B are flow charts showing an example of a method of controlling a touch sensitive razor.
Figure 16B:
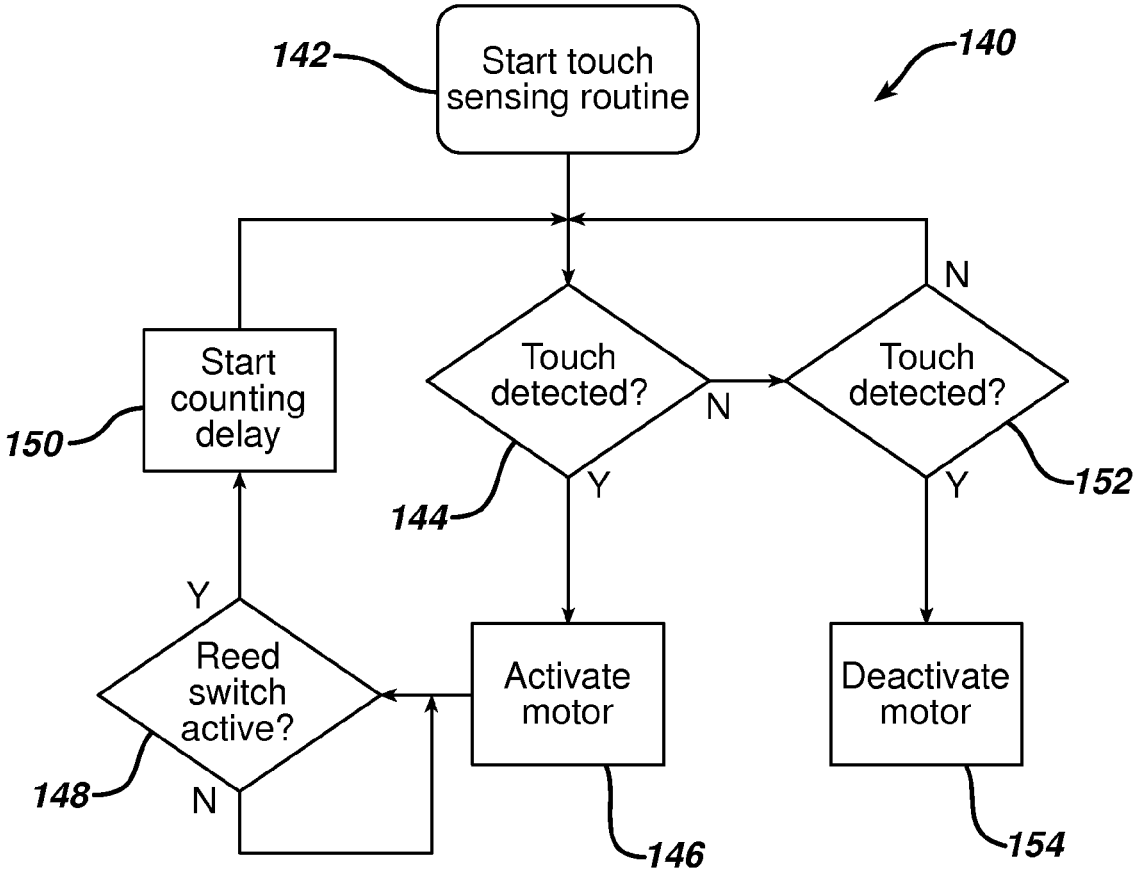

Referring to FIGS. 16A-B, a method 120 of operating razor 1 is shown. A user inserts a battery 15 into the razor 1 at step 122 and touch sensing controller 62 initializes at step 124. If the reed switch 20 is active (e.g., the razor 1 is disposed in its tray 18) at step 126, then razor 1 enters sleep mode at 128 and waits for reed switch 20 to deactivate. When reed switch 20 is not active, touch sensing controller 62 loads the hardware configuration necessary for normal touch sensing operation at step 130. Controller 62 then runs the touch sensing routine, described below, at step 132. As long as reed switch 20 remains inactive, the touch sensing routine continues to run. When reed switch activates at step 134, touch sensing controller 62 enters a low power sleep mode at step 128, ending the touch sensing routine.

Touch sensing routine 140 begins at step 142 (e.g., when the configured touch sensing controller 62 runs it) and waits for a touch to be detected at step 144. When a touch is detected, motor 24 is activated at step 146. Controller 62 then waits for the touch to be removed at step 148. Once the touch is removed, controller 62 starts counting the delay period at step 150. Controller 62 then determines whether a touch is detected during the delay period. If a touch is detected at 144, the motor remains activated (step 146) until the touch is removed (step 148) at which point the delay count restarts (step 150). If a touch is not detected and the delay has not finished counting at step 152, controller 62 continues to wait for a touch at step 144. If the delay count finishes without a touch occurring, the motor is deactivated at step 154.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A safety razor comprising:

a blade unit having at least one blade with a sharp cutting edge;

a handle comprising an electrically nonconductive casing configured to carry the blade unit;

a conductive ground member disposed within the handle;

an electrically operated device; and an electronic control device that controls actuation of the electrically operated device, the electronic control device is electrically coupled to the blade unit and the ground member and configured to be touch sensitive, wherein a touch sensing path having a capacitance is formed between the blade unit and the conductive ground member, wherein the electronic control device is configured to measure a cycle time for charging the capacitance to an upper voltage and discharging the capacitance to a lower voltage and to actuate the electrically operated device when the-blade unit makes contact with a user's skin and the cycle time exceeds a threshold value.

2. The safety razor of claim 1, wherein the ground member and the electrically nonconductive casing are configured to capacitively couple with a user when the user holds the handle and disposes the blade unit on the user's skin.

3. The safety razor of claim 1, wherein the electronic control device comprises a programmable system-on-chip.

4. The safety razor of claim 1 further comprising:

a plunger for biasing the blade unit to a shaving position; and a follower disposed on the housing.

5. The safety razor of claim 4, wherein the electronic control device is electrically coupled to the blade unit through the plunger and the follower.

6. The safety razor of claim 4, wherein the follower comprises a body member disposed in a first plane, a neck member projecting distally from the body member, and first and second contact members opposedly extending from the neck member, each of said contact members having a contact surface disposed in a second plane, wherein the contact members are configured to resiliently bend.

7. The safety razor of claim 1, wherein the electronic control device is electrically coupled to the at least one blade.

8. The safety razor of claim 1 further comprising a switch for controlling operation of the electronic control device between a normal mode and a low power consumption mode.

9. The safety razor of claim 8, wherein the switch is included in the handle.

10. The safety razor of claim 1, wherein the electrically operated device is a motor.

11. The safety razor of claim 1 further comprising an indicator for producing a signal for indicating to a razor user that the electronic control device is connected to a power source and ready to actuate the electrical device.

12. The safety razor of claim 11, wherein the indicator comprises a light emitting device.

13. The safety razor of claim 12, wherein the light emitting device is a diode.

14. The safety razor of claim 11, wherein the indicator produces an oscillation or vibration of the razor.

15. The safety razor of claim 11, wherein the indicator generates an audible signal.

* * * * *